US007101211B2

(12) United States Patent
Malone et al.

(10) Patent No.: US 7,101,211 B2
(45) Date of Patent: Sep. 5, 2006

(54) SHROUD FOR PIN AND SOCKET CONNECTION

(75) Inventors: Christopher Gregory Malone, Loomis, CA (US); Stephan Karl Barsun, Sacramento, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/832,673

(22) Filed: Apr. 27, 2004

(65) Prior Publication Data

US 2005/0239314 A1 Oct. 27, 2005

(51) Int. Cl.
*H01R 13/625* (2006.01)

(52) U.S. Cl. ..... 439/343

(58) Field of Classification Search ..... 439/343, 439/345, 374, 487, 330, 334
See application file for complete search history.

(56) References Cited

U.S. PATENT DOCUMENTS 4,969,829 A * 11/1990 Sato ..... 439/83
5,135,405 A * 8/1992 Fusselman et al. ..... 439/108
5,228,864 A * 7/1993 Fusselman et al. ..... 439/108
5,509,825 A * 4/1996 Reider et al. ..... 439/620
5,641,291 A * 6/1997 Sueki et al. ..... 439/83
5,917,706 A 6/1999 Steffen
6,259,022 B1 7/2001 Steffen
6,413,849 B1 7/2002 Yeoh et al.
6,477,051 B1 11/2002 Barsun
6,538,889 B1 3/2003 Barsun et al.
6,600,233 B1 7/2003 Yeoh et al.

FOREIGN PATENT DOCUMENTS

EP 0 428 359 5/1991
GB 2 208 759 4/1989

OTHER PUBLICATIONS

A copy of GB Search Report for Application No. GB0508611.1 mailed on Jun. 29, 2005 (3 pages).

* cited by examiner

*Primary Examiner*—Chandrika Prasad

(57) ABSTRACT

A shroud for interacting with a circuit component defining a component surface having an array of pins extending from the component surface. The shroud includes a planar member defining an array of apertures complimenting the array of the pins. The planar member is configured to interact with the circuit component to maintain uniform contact between the pins and a corresponding socket.

31 Claims, 9 Drawing Sheets

SHROUD FOR PIN AND SOCKET CONNECTION

BACKGROUND

The circuitry of programmable electronic systems, such as computer systems, telecommunication switching systems, and control systems typically include one or more circuit components attached to substrates, such as printed circuit boards (PCBs), via sockets that provide for easy removal and/or replacement of the circuit components. Such circuit components include an array of pins arranged to mate with an array of pin sleeves of a complimentary socket on the substrate. As demands for portability increase, so does the demand for smaller programmable electronic systems. In order to make a smaller programmable electronic system, smaller circuit components within the programmable electronic system have been introduced.

One method of making the smaller components includes utilizing a surface-mounted technique for attaching the pins to the substrate. The surface-mounted technique typically includes soldering each of the array of pins to one of an array of soldering pads positioned on a surface of the substrate, rather than partially implanting the pins within cavities in the substrate in accordance with a conventional through-hole mounting technique. The surface-mounted pins are typically electrically connected with the internal routing system of the substrate via the soldering pads. Surface-mounted pins allow components to have a smaller footprint and a thinner profile than components having conventional through-hole pins. Due to at least these advantages, surface-mounted pins have increased in popularity. The increased popularity of surface-mounted pins has accordingly increased the desire to improve reliability of the connection between the array of surface-mounted pins and the corresponding sockets.

Therefore, for the reasons stated above and the reasons presented in the present specification, there is a need for a circuit component assembly that improves the reliability of connections between surface-mounted pins and the complimentary socket.

SUMMARY

One aspect of the present invention relates to a shroud for interacting with a circuit component defining a component surface having an array of pins extending from the component surface. The shroud includes a planar member defining an array of apertures complimenting the array of the pins. The planar member is configured to interact with the circuit component to maintain uniform contact between the pins and a corresponding socket.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "upward," "downward," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following Detailed Description, therefore, is not to be taken in a limiting sense, and the scope of the present invention is defined by the appended claims.

Figure 1:
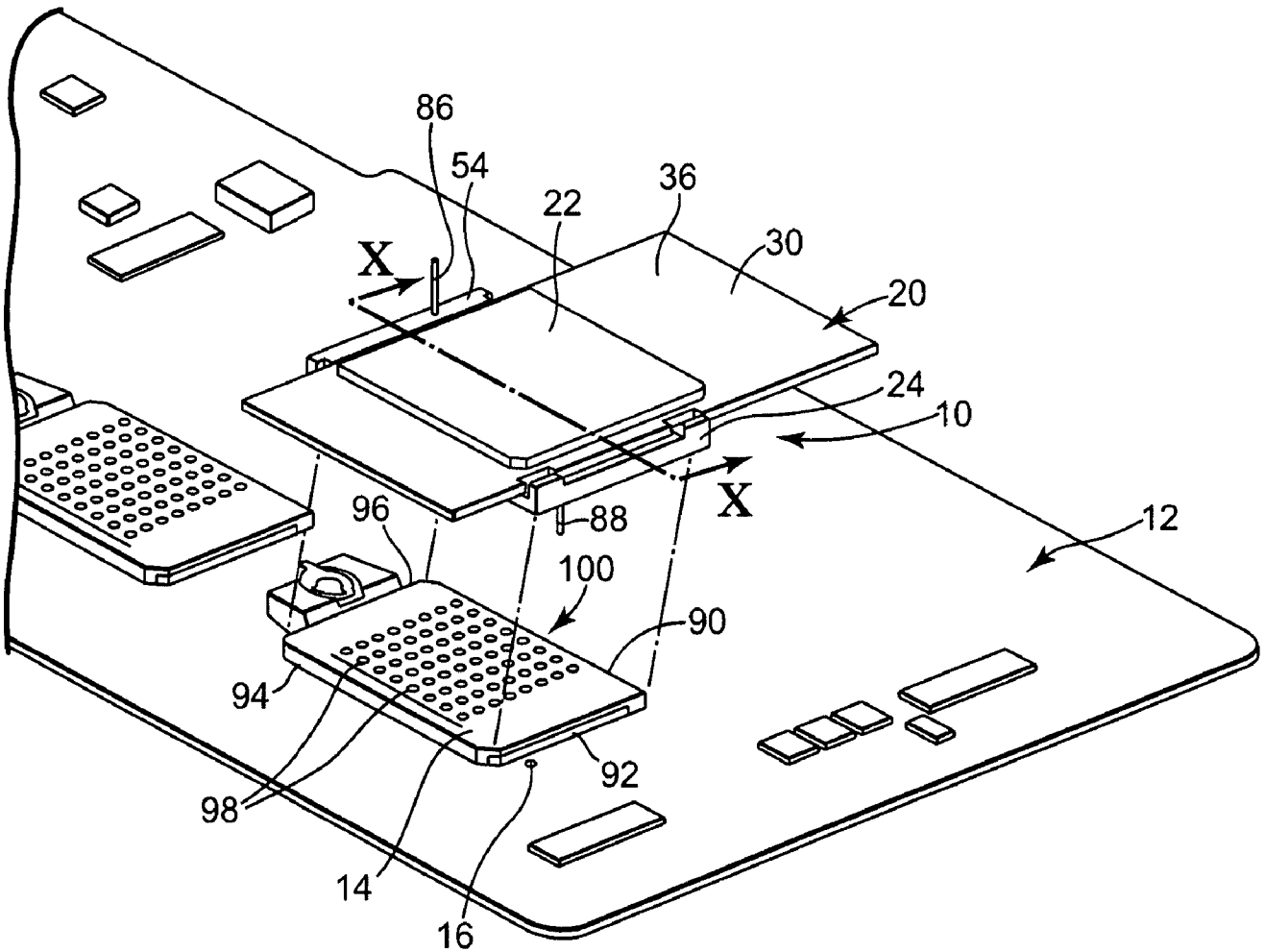
FIG. 1 is an exploded perspective view of an exemplary embodiment of a circuit component assembly and a corresponding substrate.

FIG. 1 illustrates one embodiment of a circuit component assembly 10 and a corresponding substrate 12. Substrate 12 includes a socket 14 configured to selectively receive circuit component assembly 10. Circuit component assembly 10 is configured to increase uniformity of the connection between circuit component assembly 10 and substrate 12, thereby, increasing the reliability of the computer system or other electronic system such as computer system 120 illustrated in FIG. 10, in which circuit component assembly 10 and corresponding substrate 12 are incorporated. In one embodiment, substrate 12 optionally includes at least one component alignment feature 16, which will be further described below.

Figure 2:
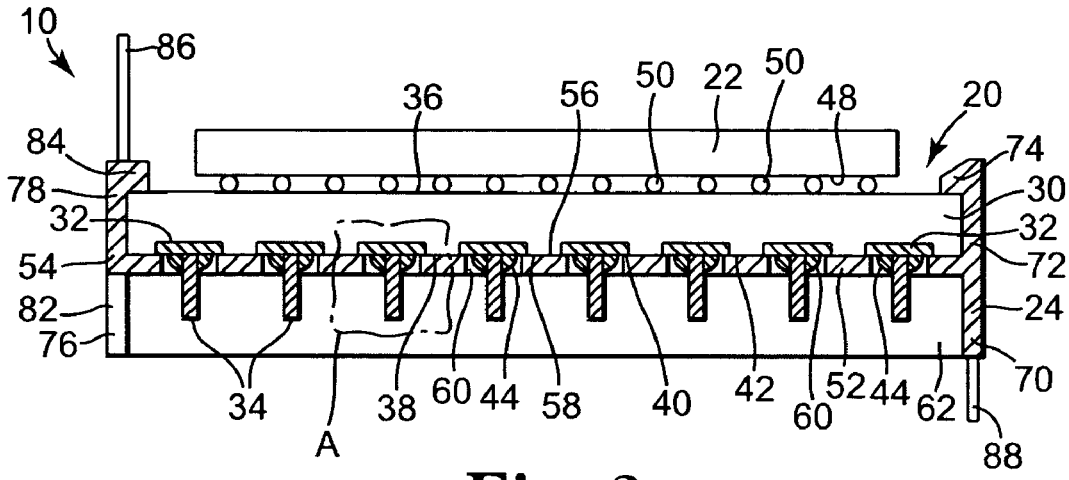
FIG. 2 is a cross-sectional view of an exemplary embodiment of the circuit component assembly of FIG. 1 taken along the line X—X.

Circuit component assembly 10 includes a component 20, an integrated circuit or microprocessor 22, and a shroud 24. As illustrated with further reference to FIG. 2, component 20 includes a substrate or printed circuit board (PCB) 30, a plurality of soldering pads 32, and a plurality of pins 34. PCB 30 defines a first or top surface 36 and a second or bottom surface 38 opposite top surface 36. In one embodiment, PCB 30 is formed of ceramic, FR-5 or FR-4 epoxy-glass, polymide-glass, benzocyclobutene, Teflon™, other epoxy resins, or other suitable materials.

In one embodiment, each of the soldering pads 32 is formed of a metal, such as but not limited to copper. The plurality of soldering pads 32 are coupled with the bottom surface 38 of the PCB 30 in an array. In one embodiment, each of the soldering pads 32 is embedded into bottom surface 38 of PCB 30 such that bottom surface 38 of PCB 30 and a bottom surface 40 of the soldering pads 32 collectively define a planar bottom surface 42 of component 20. Component 20, in particular PCB 30, further includes an imbedded, multi-layer metallurgical system of interconnects (not shown), which electrically connects internal components as well as the interface areas on top surface 36 with the interface areas on bottom surface 38. The metallurgical system of interconnects is not shown as the metallurgical system is not part of the present invention and is well known in the art.

Figure 2A:
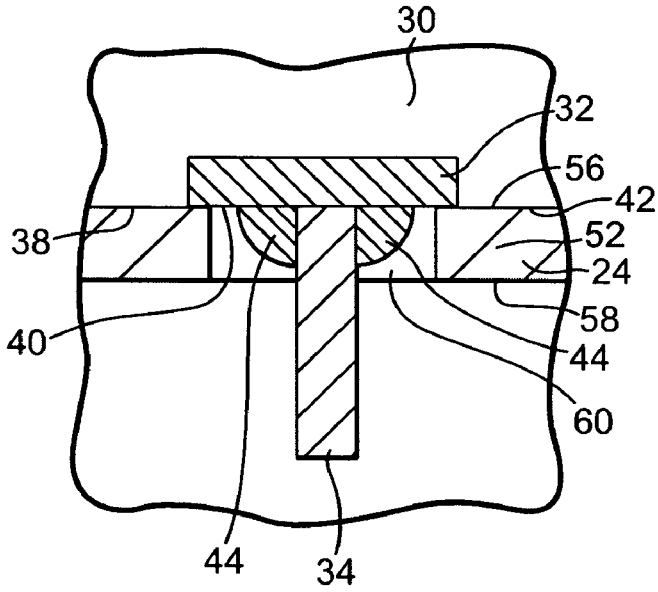
FIG. 2A is an enlarged view of a portion of the circuit component assembly as indicated by "2A" in FIG. 2.

In one embodiment, each of the plurality of pins 34 is a single shaft. Each pin 34 is soldered to one of the soldering pads 32. In particular, a solder fillet 44 is formed around each of the plurality of pins 34 to secure each of the plurality of pins 34 to the respective soldering pad 32. Each of the solder fillets 44 is a ribbon of solder, which is applied around the respective pin 34 in molten form and upon cooling secures the pin 34 to the soldering pad 32. In one embodiment, the solder fillet 44 is formed of a standard tin-lead (Sn—Pb) solder composition, a tin-antimony (Sn—Sb) solder composition, or any other solder composition as will be apparent to those of ordinary skill in the art. As such, as clearly illustrated in the detailed view of FIG. 2A, each solder fillet 44 extends from bottom surface 42 of component 20 around each of the plurality of pins 34.

Figure 3:
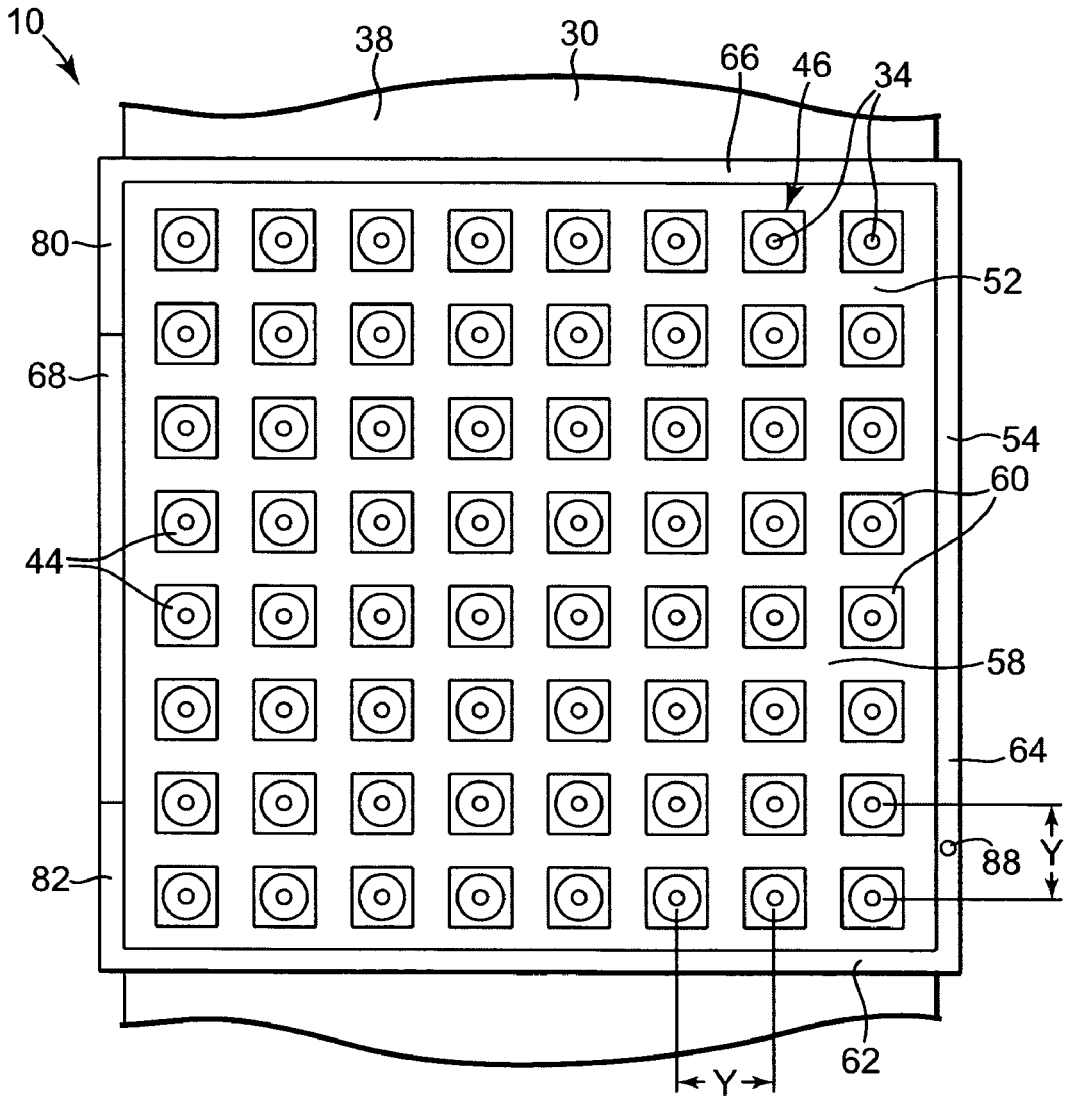
FIG. 3 is a partial bottom view of an exemplary embodiment of the circuit component assembly of FIG. 1.

Notably, inherent to the soldering process, the plurality of solder fillets 44 are not uniform in shape and size and, as such, do not each extend the same distance from bottom surface 42. Rather, each solder fillet 44 extends a slightly different distance from bottom surface 42. Upon cooling of each solder fillet 44, the corresponding pin 34 is secured to the respective soldering pad 32. As illustrated in FIG. 3, the plurality of pins 34 are arranged in an array 46. Although illustrated as an 8×8 grid, array 46 is any uniform or non-uniform arrangement of the plurality of pins 34 on PCB 30. In one embodiment, each of the plurality of pins 34 is approximately 3 mm in length and solder fillets 44 extend an average approximately 1 mm from the respective soldering pad 32.

Referring once again to FIG. 2, integrated circuit or microprocessor 22 defines an interface surface 48 and is coupled with PCB 30. More particularly, interface surface 48 of integrated circuit 22 is electrically and mechanically connected to top surface 36 of PCB 30 via a plurality of solder bumps 50. In one embodiment, each of the plurality of solder bumps 50 consists of standard Sn—Pb solder, Sn—Sb solder, or any solder as will be apparent to those of ordinary skill in the art. During the assembly process, the plurality of solder bumps 50 are heated to a temperature sufficient to melt the plurality of solder bumps 50. The melted plurality of solder bumps 50 flow onto adjoining pads (not shown) on top surface 36 of PCB 30. When cooled, integrated circuit 22 is firmly attached to PCB 30 via the solder provided by the plurality of solder bumps 50.

Figure 4:
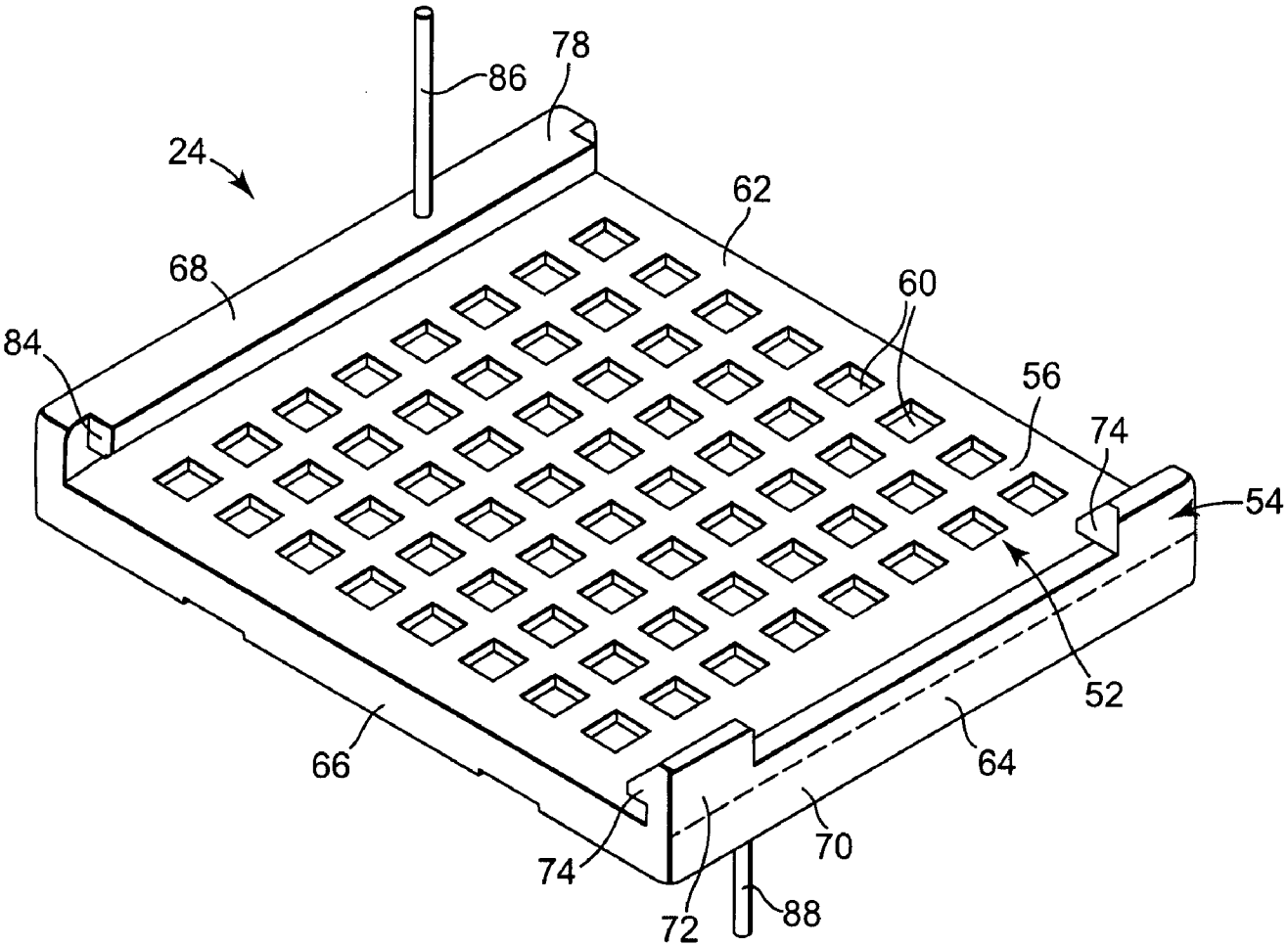
FIG. 4 is a perspective view of an exemplary embodiment of a shroud of the circuit component assembly of FIG. 1.

As illustrated in FIG. 4, in one embodiment, the shroud 24 includes a planar member 52 and a frame 54. In one embodiment, the planar member 52 defines a first surface 56, a second surface 58 opposite first surface 56, and a plurality of apertures 60. Each of the plurality of apertures 60 extends through and between the surfaces 56 and 58 and is formed to correspond with one of the plurality of pins 34 of the component 20. More particularly, planar member 52 forms the plurality of apertures 60 positioned in an array that is complimentary to the array arrangement of the plurality of pins 34 on PCB 30. For example, in one embodiment illustrated in FIG. 3, substrate 20 includes the plurality of pins 34 arranged in an 8×8 grid and spaced a distance "Y" on center, and therefore, the plurality of apertures 60 of shroud 24 are arranged in an 8×8 grid and spaced the distance "Y" on center to compliment the plurality of pins 34. Although illustrated as rectangular in shape, the plurality of apertures 60 each may take on a circular, parabolic, rectangular, or other shape as would be apparent to those of ordinary skill in the art. Planar member 52 has a thickness that is greater than the greatest height one of the plurality of solder fillets 44 extends from bottom surface 42 of component 20. In addition, planar member 52 is substantially uniform in thickness.

Figure 5:
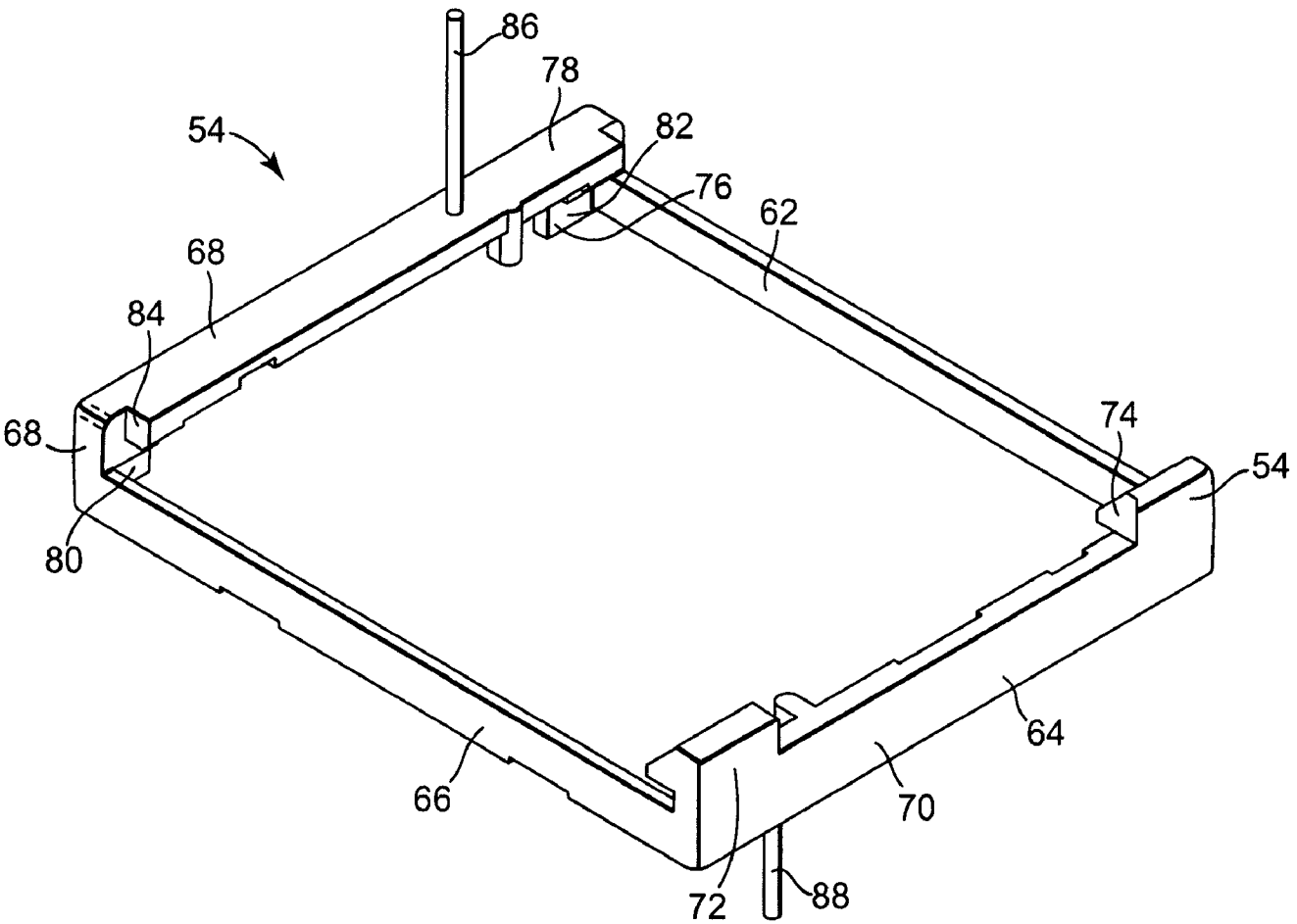
FIG. 5 is a perspective view of an exemplary embodiment of a portion of the shroud of FIG. 4.

Referring to FIGS. 4 and 5, frame 54 extends around a perimeter of planar member 52. In one embodiment, frame 54 includes a first wall 62, a second wall 64, a third wall 66, and a fourth wall 68. Second wall 64 extends from first wall 62. Third wall 66 extends from second wall 64 opposite first wall 62. Fourth wall 68 extends from third wall 66 opposite second wall 64 to first wall 62 opposite second wall 64. Each of the walls 62, 64, 66 and 68 are substantially perpendicular to one another to form frame 54 as a square or rectangular member to interact with each of the edges of planar member 52. First wall 62 and third wall 66 are simple elongated members and each extend from planar member 52 in a first or downward direction substantially perpendicular to planar member 52. Second wall 64 extends between first wall 62 and third wall 66. Second wall 64 includes a first or bottom portion 70 and a second or top portion 72. Bottom portion 70 extends between walls 62 and 66 and from planar member 52 in the first direction. Top portion 72 extends between walls 62 and 66 and from planar member 52 in a second or upward direction opposite the first direction. In particular, top portion 72 extends from bottom portion 70 to define at least one retention tab 74 opposite to and spaced from planar member 52. Retention tab 74 extends towards fourth wall 68. In one embodiment, retention tab 74 is spaced from planar member 52 a distance equal to or greater than a thickness of PCB 30. In one embodiment, second wall 64 defines two retention tabs 74 spaced from one another.

Fourth wall 68 defines a first or bottom portion 76 and a second or top portion 78. First portion 76 extends at least partially between first and third walls 62 and 66 from planar member 52 in the first or downward direction. In one embodiment, the first portion 76 includes a first segment 80 and a second segment 82 spaced from first segment 80. First segment 80 extends from the third wall 66 partially towards the first wall 62. Second segment 82 extends from the first wall 62 partially towards the third wall 66. Second portion 80 extends between third and first walls 66 and 62 in the second or upward direction to define at least one retention tab 84 opposite to and spaced from planar member 52. In one embodiment, retention tab 84 is an elongated member extending from the second portion 78 towards the second wall 64. Retention tab 84 is spaced above planar member 52 a distance equal to or greater than the thickness of PCB 30.

Frame 54 optionally includes a heat sink alignment feature 86. In one embodiment, heat sink alignment feature 86 is coupled with and extends upwardly from second portion 78 of fourth wall 68. In another embodiment, heat sink alignment feature 86 is coupled with and extends upwardly from top portion 72 of second wall 64. Heat sink alignment feature 86 extends from the fourth wall 68 or the second wall 64 a distance greater than a height integrated circuit 22 extends from top surface 36 of PCB 30.

Frame 54 optionally includes a substrate alignment feature 88. In one embodiment, substrate alignment feature 88 is coupled with and extends downwardly from the bottom portion 70 of second wall 64. In other embodiments, substrate alignment feature 88 extends downwardly from any of walls 62, 66, and 68. In one embodiment, frame 54 includes a plurality of substrate alignment features 88.

In one embodiment, shroud 24 is formed as a single piece of plastic that is treated or inherently formed to resist high temperatures and electrostatic discharge. In one embodiment, shroud 24 is machined, injection molded, or formed with another suitable technique. In one embodiment, planar member 52 and frame 54 are formed as separate pieces joined together. In one embodiment, planar member 52 is formed of a Mylar® film or Polycarbonate/Acrylonite Butadiene Styrene alloy (PC/ABS), and frame 54 is formed of a heat resistant and electrostatic discharge resistant plastic, which is similar to the plastic described above. In one embodiment, planar member 52 and frame 54 are each separately formed of a heat resistant and electrostatic discharge resistant plastic as described above. Separate planar member 52 and frame 54 are coupled in a suitable manner, such as by snap-fit connection, friction fit, etc. In one embodiment, planar member 52 has a thickness in the range of approximately 1 mm to 2 mm.

Component 20, more particularly PCB 30, is positioned between top portion 72 of second wall 62 and top portion 72 of fourth wall 68 such that bottom surface 38 of PCB 30 is positioned to abut first surface 56 of planar member 52. Retention tabs 74 and 84 interact with top surface 36 of PCB 30, thereby, maintaining PCB 30 between first surface 56 of planar member 52 and retention tabs 74 and 84. In one embodiment, shroud 24 is additionally or alternatively coupled with bottom surface 38 of PCB with adhesive. Upon placement of shroud 24 upon component 20, each of the pins 34 extends through a corresponding aperture 60 of shroud 24. As such, each of the plurality of pins 34 extends from bottom surface 42 of component 20 through and past surfaces 58 and 60 of planar member 52. Notably, each of the plurality of pins 34 extends beyond surface 60 of planar member 52 a distance sufficient to effectuate an electrical connection with socket 14 as is further described below.

Referring once again to FIG. 1, upon assembly of circuit component assembly 10, circuit component assembly 10 is attached to substrate 12 via socket 14. Socket 14 extends from substrate 12 to form a first edge 90, a second edge 92, and third edge 94, and a fourth edge 96. Each of the edges 90, 92, 94, and 96 are joined to one another to define a rectangular or square shape. Socket 14 additionally defines a plurality of pin sleeves 98 arranged in an array 100 complimentary to the arrangement of pins 34 upon PCB 30. As such, each pin sleeve 98 is configured to receive and selectively maintain one of the plurality of pins 34. In particular, the connection between one of the plurality of pins 34 and one of the plurality of pin sleeves 98 provides the physical and electrical interconnect between circuit component assembly 10 and substrate 12.

Figure 6:
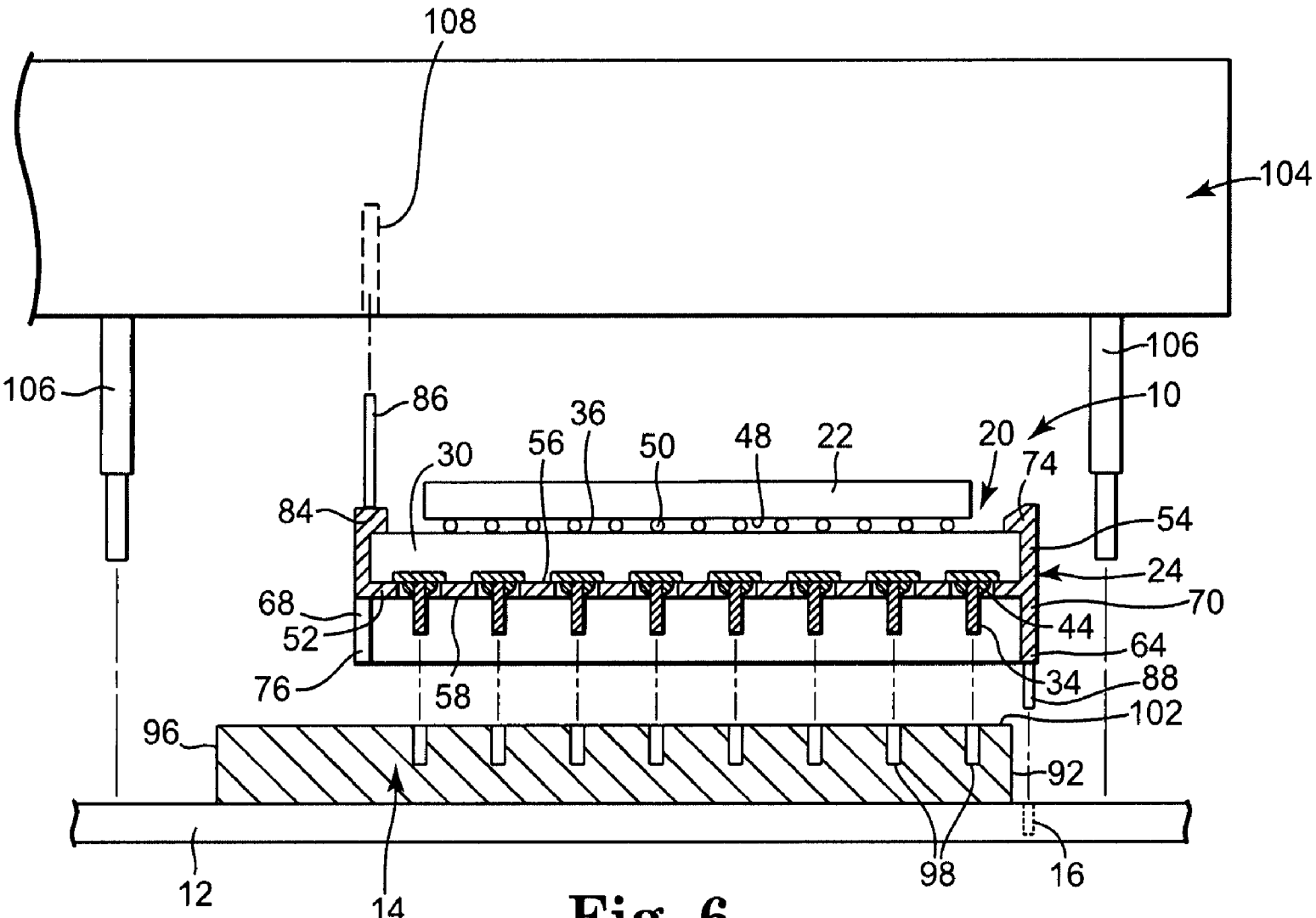
FIG. 6 is an exploded, cross-sectional view of an exemplary embodiment of the circuit component assembly of FIG. 1 taken along the line X—X, the corresponding substrate, and a heat sink.

Referring to FIG. 6, during assembly, circuit component assembly 10 is positioned such that each of the plurality of pins 34 is received by one of the plurality of pin sleeves 98. In one embodiment, bottom section 68 of frame 54 is configured to interact with socket 14 to provide gross alignment of circuit component assembly 10 with socket 14. In particular, the first wall 62, bottom portion 70 of second wall 64, third wall 66, and bottom portion 76 of fourth wall 68 are aligned to surround and interact with first edge 90, second edge 92, third edge 94, and fourth edge 96 of socket 14, respectively. As such, interaction between walls 62, 64, 66, and 68 with edges 90, 92, 94, and 96 provides gross or preliminary alignment of circuit component assembly 10 with socket 14.

In one embodiment, gross alignment is additionally or alternatively achieved by aligning each substrate alignment feature 88 of frame 54 with a corresponding component alignment feature 16 of substrate 12. In one embodiment, component alignment feature 16 is a cavity or other feature capable of interacting with substrate alignment feature 88.

Following gross alignment of circuit component assembly 10 with socket 14, circuit component assembly 10 is further lowered upon socket 14 and each of pins 34 is received by a corresponding pin sleeve 98. Upon complete positioning of circuit component assembly 10 with respect to socket 14, second surface 58 of planar member 52 interacts with and abuts a top surface 102 of socket 14. Notably, since planar member 52 has a thickness greater than the height each of the solder fillets 44 extends from bottom surface 38 to PCB 30, interaction between planar member 52 and top surface 102 of socket 14 prevents interaction of the solder fillets 44 with top surface 102 of socket 14. Since planar member 52 is uniformly formed, circuit component assembly 10 maintains component 20 with a uniform spacing from socket 14 and, therefore, positions the plurality of pins 34 for uniform contact with the plurality of pin sleeves 98. This is in direct contrast to interaction of a circuit component assembly 10 without shroud 24, in which each non-uniform solder fillet 44 interacts with top surface 102 of socket 14 resulting in a non-uniform interaction between circuit component assembly 10 and socket 14, thereby, decreasing reliability of the connection between circuit component assembly 10 and socket 14.

In one embodiment, a heat sink or other heat dissipation device 104 is placed over circuit component assembly 10 and socket 14. In particular, circuit component assembly 10 is sandwiched between heat sink 104 and substrate 12. In one embodiment, heat sink 104 optionally includes an alignment cavity 108 sized and positioned to receive heat sink alignment feature 86 of shroud 24 to facilitate alignment of heat sink 104 with respect to circuit component assembly 10. As such, cavity 108 first interacts with optional heat sink alignment feature 86 to preliminarily align heat sink 104 with circuit component assembly 10. In one embodiment, shroud 24 includes a plurality of heat sink alignment features 86 and heat sink 104 includes a corresponding plurality of alignment cavities 108. In one embodiment, shroud 24 includes at least one alignment cavity (not shown) and heat sink 104 includes at least one corresponding heat sink alignment feature (not shown), which interact similarly but conversely to alignment cavity 108 and heat sink alignment feature 86.

In another embodiment, heat sink 104 is coupled with circuit component assembly 10 before circuit component assembly 10 is received by socket 14. As such, heat sink 104 and circuit component assembly 10 are collectively aligned and lowered onto socket 14. Heat sink 104 is coupled with substrate 12 in a manner apparent to those of ordinary skill in the art, such as with screws or other retention hardware 106, to secure heat sink 104 and securely sandwich circuit component assembly 10 between heat sink 104 and substrate 12.

When heat sink 104 is secured to substrate 12, a retention mechanism (not shown) is attached or integral to heat sink 104 provides a compressive force using spring(s), screws or other means of applying load to circuit component assembly 10. Upon application of the compressive force of heat sink 104, the uniform connection of circuit component assembly 10 to socket 14 is of increased importance. By incorporating shroud 24, uniform contact between circuit component assembly 10 and socket 14 can be achieved despite inconsistencies in the connection of pins 34 to PCB 30 (i.e., non uniformity of each fillet 44 for surface-mounted pins 34). With this in mind, the compressive force or load of heat sink 104 is more uniformly transmitted to the circuit-component assembly 10 and socket 44. The more uniform connection and interaction between circuit component assembly 10 and socket 14 achieved by use of shroud 24 decreases or prevents areas of high stress or instability, thereby, increasing reliability of the connection between circuit component assembly 10 and substrate 12 via socket 14.

Figure 7:
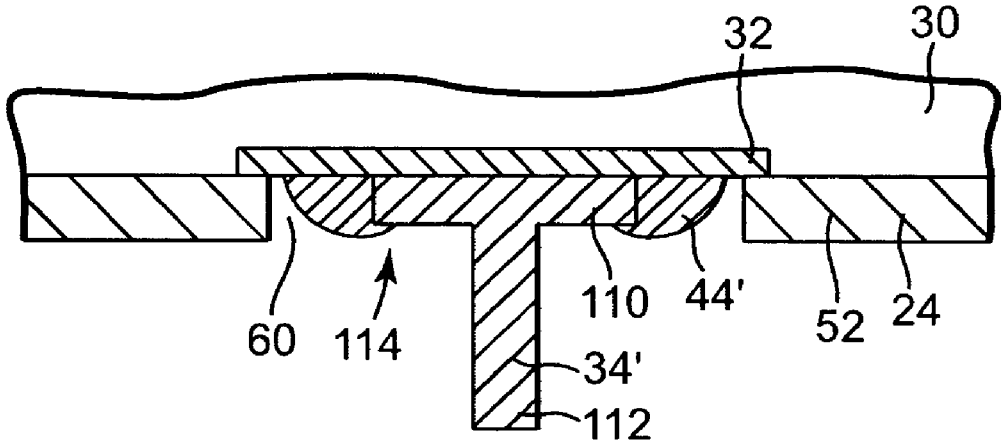
FIG. 7 is a partial, cross-sectional view of another exemplary embodiment of a surface-mounted pin and a portion of a shroud.

FIG. 7 illustrates an alternative embodiment of one of the plurality of pins 34 generally at 34'. In this embodiment, pin 34' is a butt-head pin having a flat-top head 110 and a shaft 112 extending from the center of the flat-top head 110. In this embodiment, solder fillets 44' are positioned to connect flat-top head 110 to each of the respective soldering pads 32. Notably, solder fillets 44' often extend slightly over flat-top head 110 presenting a non-uniform interface surface 114 and, therefore, still requiring shroud 24 to present planar member 52 for uniform interface with socket 14 (shown in FIG. 6).

Figure 8:
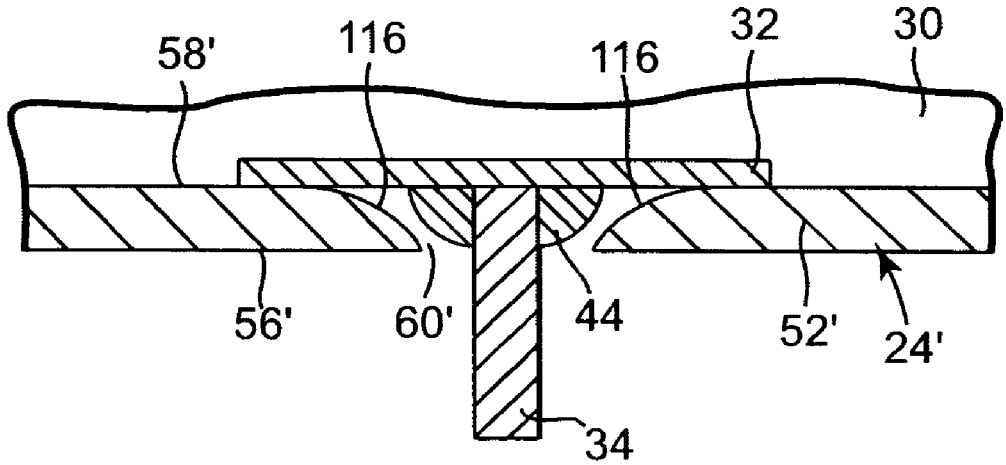
FIG. 8 is a partial, cross-sectional view of another exemplary embodiment of a surface-mounted pin and a portion of a shroud.

FIG. 8 illustrates an alternative embodiment of shroud 24 generally at 24'. In this embodiment, the shroud 24' includes a planar member 52' defining a plurality of the apertures 60' extending from a first surface 56' of planar member 52' to second surface 58' of planar member 52' in an arcuate or angular manner and, as such, extend slightly over each solder fillet 44 to form a curved aperture edge or boundary 116. By forming each aperture 60' arcuately or angularly, second surface 58' of planar member 52' extends closer to each of the plurality of pins 34 than second surface 58 of planar member 52.

Figure 9:
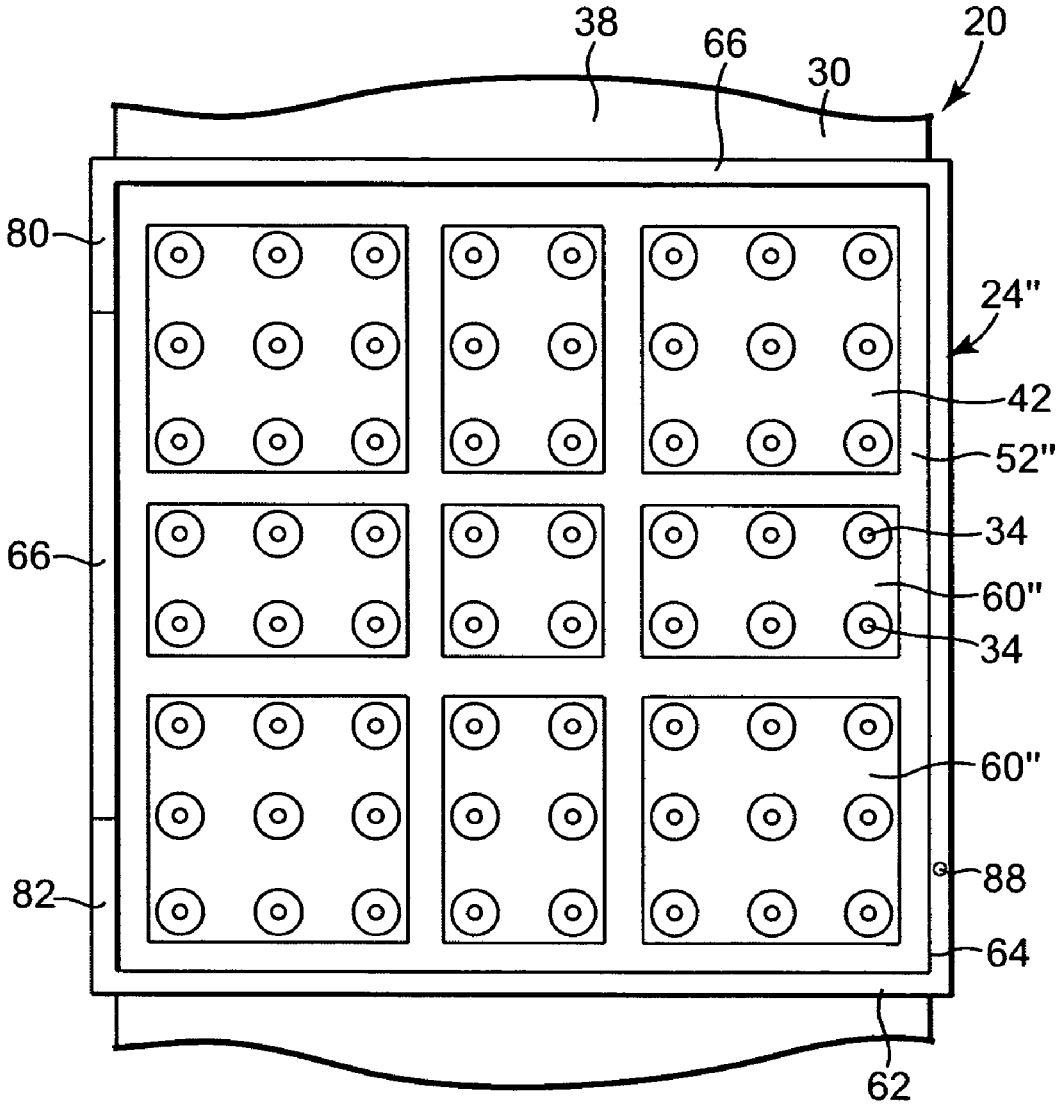
FIG. 9 is a partial bottom view of another exemplary embodiment of a circuit board assembly including the circuit component assembly of FIG. 1.

FIG. 9 illustrates yet another embodiment of shroud 24 generally at shroud 24", which is similar to shroud 24 except for those differences specifically enumerated herein. In this embodiment, shroud 24" defines a planar member 52" having a plurality of apertures 60". Each of the plurality of apertures 60' is sized to receive more than one of the plurality of pins 34. As such, less surface area of planar member 52" remains for interaction with surface 42 of component 20 and top surface 102 of socket 14 (shown in FIG. 6). The larger apertures 60" still, however, leave a sufficient surface area of planar member 52" between apertures 60" to interact with socket 14 to maintain PCB 30 at a uniform spacing with respect to socket 14. Otherwise stated, planar member 52" maintains sufficient rigidity to uniformly maintain the distance between top surface 102 of socket 14 and surface 42 of component 20 thereby, maintaining the benefits of a uniform connection between pins 34 and pin sleeves 98 (shown in FIG. 6). Notably, the alternative embodiments of FIGS. 7, 8, and 9 can be interchangeable and adaptable to be used with one another as well as to be used with the embodiment illustrated in FIGS. 2–4.

Figure 10:
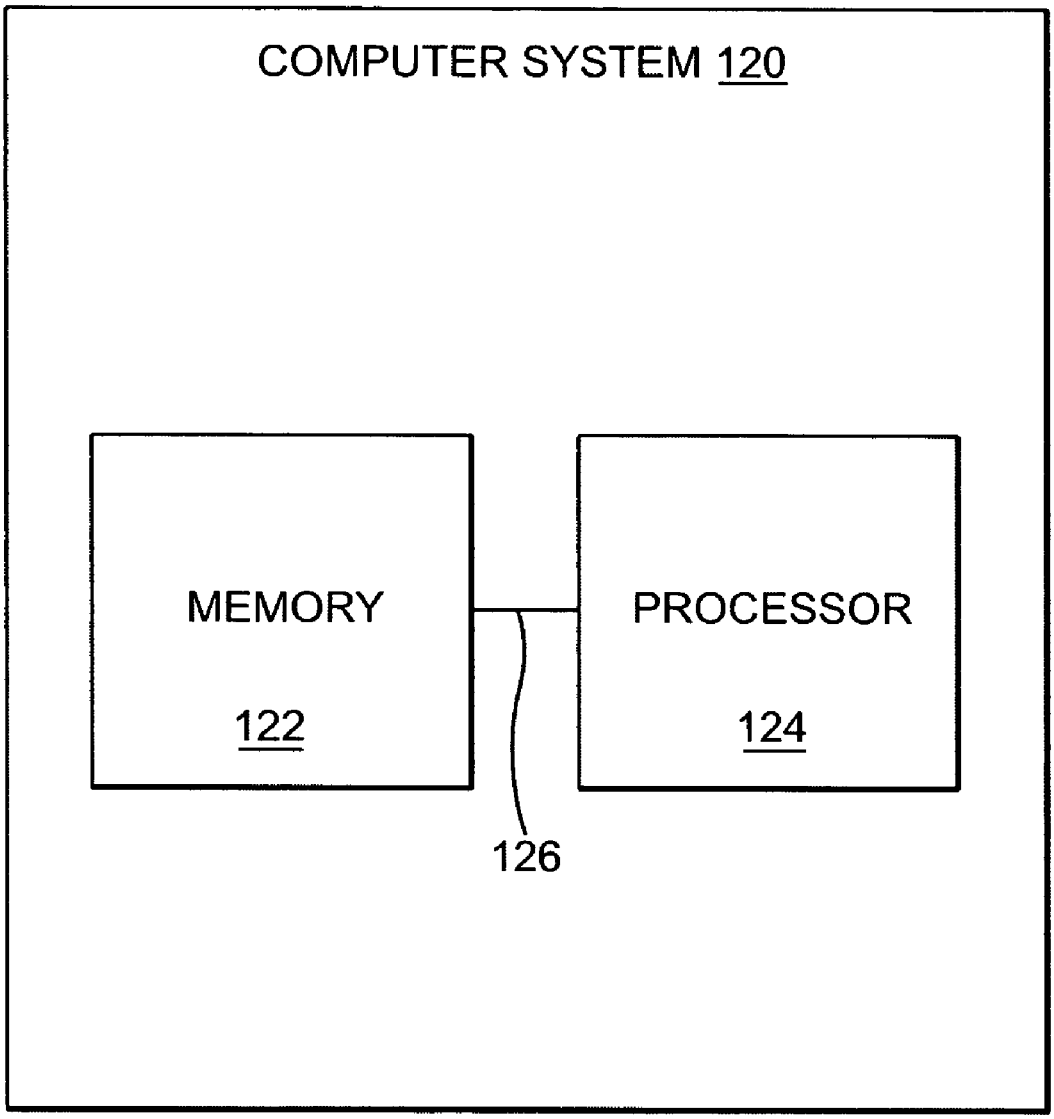
FIG. 10 is a block diagram of one embodiment of a computer system.

FIG. 10 illustrates one embodiment of a computer system generally at 120. Computer system 120 may be any type of computer system such as desktop, notebook, mobile, workstation, or server computer. Computer system 120 includes a processor 122 and a memory 124. Processor 122 is coupled to memory 124 at least in part by connector 126 and executes instructions retrieved from memory 124. In one embodiment, processor 122 is circuit component assembly 10 described above and illustrated in FIG. 1. Memory 124 comprises any type of memory such as RAM, SRAM, DRAM, SDRAM, and DDR SDRAM. In one embodiment, memory 124 includes instructions and data previously loaded to memory 124 from an input device (not shown) such as a hard drive or a CD-ROM.

Although specific embodiments have been illustrated and described herein, it will be appreciated by those of ordinary skill in the art that a variety of alternate and/or equivalent implementations may be substituted for the specific embodiments shown and described without departing from the scope of the present invention. For example, although described above for use with surface-mounted pins, the shroud can be used in any pin and socket connection (i.e., pin and socket connection using pressed-in or through hole mounted pins) to decrease interference issued between the PCB and the socket. This application is intended to cover any adaptations or variations of the specific embodiments discussed herein. Therefore, it is intended that this invention be limited only by the claims and the equivalents thereof.

What is claimed is:

1. A shroud for interacting with a circuit component defining a component surface having an array of surface-mounted pins extending from the component surface to interact with a corresponding socket, the shroud comprising:

a planar member defining an array of apertures complimenting the array of surface-mounted pins, the planar member configured to interact with the component surface to maintain uniform contact between the surface-mounted pins and the corresponding socket, wherein the planar member has a thickness greater than a height of a solder fillet around each of the surface-mounted pins.

2. The shroud of claim 1, wherein the planar member defines a first surface and a second surface opposite the first surface, the first surface adapted to interact with the circuit component, the second surface adapted to interact with the corresponding socket.

3. The shroud of claim 1, further comprising:

a frame coupled with and extending around the planar member, the frame configured to couple with the circuit component.

4. The shroud of claim 3, wherein the frame includes at least one retention tab configured to facilitate coupling the shroud with the circuit component.

5. The shroud of claim 3, wherein the frame includes a plurality of walls that provide for gross alignment of the circuit component with the corresponding socket.

6. The shroud of claim 3, wherein the frame is formed of plastic.

7. The shroud of claim 3, wherein the frame and the planar member are formed as a single homogenous piece.

8. The shroud of claim 1, wherein the planar member is formed of Mylar.

9. The shroud of claim 1, wherein the planar member has a thickness less than a length of the pins.

10. The shroud of claim 1, further comprising:

a heat sink alignment feature.

11. The shroud of claim 1, further comprising:

a substrate alignment feature.

12. A circuit component assembly comprising:

a circuit component defining a component surface having an array of surface-mounted pins extending from the component surface; and a shroud coupled with the circuit component, the shroud including a planar member positioned adjacent the component surface and defining a plurality of apertures, sized and positioned to compliment the array of surface-mounted pins, wherein each of the array of surface-mounted pins extend through one of the plurality of apertures, and the shroud facilitates uniform contact between each of the surface-mounted pins and a corresponding socket;

wherein the planar member has a thickness greater than a height of a fillet around each of the surface-mounted pins.

13. The circuit component assembly of claim 12, wherein each of the surface-mounted pins extends beyond the planar member a sufficient length to establish a connection with the socket.

14. The circuit component assembly of claim 12, wherein the circuit component is a processor.

15. The circuit component assembly of claim 12, wherein the shroud includes a frame, the frame coupled with and extending around the planar member.

16. The circuit component assembly of claim 15, wherein the frame is formed of plastic.

17. The circuit component assembly of claim 15, wherein the frame and the planar member are formed as a single homogenous piece.

18. The circuit component assembly of claim 15, wherein the frame includes a heat sink alignment feature.

19. The circuit component assembly of claim 15, wherein the frame includes a substrate aligmnent feature.

20. The circuit component assembly of claim 15, wherein the frame includes at least one retention tab to facilitate coupling the shroud with the circuit component assembly.

21. The circuit component assembly of claim 15, wherein the frame provides for gross alignment with the corresponding socket.

22. The circuit component assembly of claim 12, wherein the planar member is formed of Mylar.

23. The circuit component assembly of claim 12, wherein the planar member has a thickness less than the length of the surface-mounted pins.

24. A computer system comprising:

a circuit component assembly including:

a circuit component defining a component surface having an array of surface-mounted pins extending from the component surface; and a shroud coupled with the circuit component, the shroud including a planar member positioned adjacent the component surface and defining a plurality of apertures, sized and positioned to compliment the array of surface-mounted pins, wherein each of the array of surface-mounted pins extend through one of the plurality of apertures, wherein the shroud facilitates uniform contact between each of the surface-mounted pins and a corresponding socket;

wherein the planar member has a thickness greater than a height of a fillet around each of the surface-mounted pins.

25. The computer system of claim 24, wherein each of the surface-mounted pins extends beyond the planar member a sufficient length to establish a connection with the socket.

26. The computer system of claim 24, wherein the circuit component is a processor.

27. The computer system of claim 24, wherein the shroud includes a frame, the frame coupled with and extending around the planar member.

28. The computer system of claim 27, wherein the frame and the planar member are formed as a single homogenous piece.

29. The computer system of claim 27, wherein the frame includes a heat sink alignment feature.

30. The computer system of claim 27, wherein the frame includes at least one retention tab to facilitate coupling the shroud with the circuit component assembly.

31. The computer system of claim 27, wherein the frame provides for gross alignment with the corresponding socket.

* * * * *

UNITED STATES PATENT AND TRADEMARK OFFICE

CERTIFICATE OF CORRECTION

PATENT NO. : 7,101,211 B2
APPLICATION NO. : 10/832673
DATED : September 5, 2006
INVENTOR(S) : Christopher Gregory Malone et al.

It is certified that error appears in the above-identified patent and that said Letters Patent is hereby corrected as shown below:

In column 9, line 21, in Claim 19, delete "aligmnent" and insert -- alignment --, therefor.

Signed and Sealed this

Twenty-second Day of December, 2009

David J. Kappos

David J. Kappos
*Director of the United States Patent and Trademark Office*